United States Patent [19]

Anderson et al.

[11] Patent Number: 4,806,156

[45] Date of Patent: Feb. 21, 1989

[54] PROCESS FOR THE PRODUCTION OF A BATH OF MOLTEN METAL OR ALLOYS

[75] Inventors: Sara H. Anderson, Westmont; Noel F. Lutgen, Dowyers Grove, both of Ill.

[73] Assignee: Liquid Air Corporation, Walnut Creek, Calif.

[21] Appl. No.: 77,168

[22] Filed: Jul. 24, 1987

[51] Int. Cl.[4] ..... C22B 9/00

[52] U.S. Cl. ..... 75/96

[58] Field of Search ..... 75/96

[56] References Cited

U.S. PATENT DOCUMENTS

| | | | |
|---|---|---|---|
| 3,400,752 | 9/1968 | Unsworth | 75/96 |
| 3,868,987 | 3/1975 | Galey | 75/10 C |
| 4,089,678 | 5/1978 | Hanawalt | 75/96 |
| 4,093,553 | 3/1975 | Galey | 75/10 C |
| 4,178,980 | 12/1979 | Gilbert | 164/66 |
| 4,181,522 | 1/1980 | Galey | 75/96 |
| 4,211,269 | 8/1980 | Bentz | 164/67 |
| 4,460,409 | 7/1984 | Devalois | 75/96 |
| 4,657,587 | 4/1987 | Savard | 75/96 |

FOREIGN PATENT DOCUMENTS

| | | |
|---|---|---|
| 969323 | 6/1975 | Canada . |
| 973366 | 8/1975 | Canada . |

*Primary Examiner*—Peter D. Rosenberg

*Attorney, Agent, or Firm*—Lee C. Robinson, Jr.

[57] ABSTRACT

Liquid argon, nitrogen or carbon dioxide is poured onto the surface of a bath of molten metal in a furnace.

According to the invention, liquefied gas is discharged onto the surface in an amount which ranges from about 0.025 to 0.060 lb/cu. in. of metal in the furnace, while a skirt is preferably set around the open end of said furnace.

Oxygen concentration above the bath remains lower than about 3.0%, while hydrogen and nitrogen pick up are reduced.

7 Claims, 1 Drawing Sheet

PROCESS FOR THE PRODUCTION OF A BATH OF MOLTEN METAL OR ALLOYS

BACKGROUND OF THE INVENTION

1. FIELD OF THE INVENTION

The invention relates to a process for the production of a bath of molten metal or alloys wherein liquid nitrogen, argon or carbon dioxide is discharged above the bath of molten metal or alloys throughout the to a related apparatus to discharge said liquid above said bath.

2. PRIOR ART

It is known from British Pat. No. 987 190 to cast continuously a molten metal from a ladle into an ingot mould and to shield the jet of molten metal with a solidified or liquefied inert gas such as liquid nitrogen (when the presence of this element in the metal is not harmful) or argon and to also shield the surface of molten metal in said ladle to avoid oxygen, hydrogen and nitrogen pick-up from the surrounding atmosphere.

In electrical furnaces, molten metal comes from the heating up of pieces of metal or of scrap metal which are progressively melted in said furnace, while new pieces of metal or scrap metal are added throughout the melting phase.

Almost any open face surface of molten metal can be protected against oxygen, hydrogen and/or nitrogen pick-up by injection of liquid argon, nitrogen (if nitrogen pick-up is not a problem) or carbon dioxide snow above the said surface. Said process makes it possible to prevent contamination from atmospheric oxygen and also from humidity generating hydrogen in the melt or from nitrogen in cases where liquid nitrogen is not used.

Furthermore, it is possible with said process to protect the pieces of scrap metal or new stocks of metal in the stage of pre-heating above the liquid bath of molten metal prior to melting. The atmosphere above the metal is selected according to the nature of metals, alloyed metals, alloys or pure metals and it must be maintained above and around the elements of the charge throughout the whole melting and holding operations, from the very moment the charge begins to heat up, to the moment the metal is tapped.

Contrary to the shielding of the surface of molten metal with argon, nitrogen or carbon dioxide in the gaseous state, where the injection velocity of said gases creates turbulence and hence an ingress of atmospheric air diluting the inert atmosphere, protection of the metal with liquefied gases makes it possible for said liquefied gases to reach the bottom of the furnace or the surface of the molten metal : they first vaporize as cold heavy gases (which are heavier then the atmosphere at room temperature) which in turn, heat-up, expand and flush out all the atmospheric air in the furnace.

However, there are some limitations to this protection against hydrogen, nitrogen and/or oxygen pick-ups.

When the pieces of metal are partly covered by water, this water can come into contact with the molten bath and generate hydrogen bubbles in the bath along with some metal oxides. Hydrogen can also be generated by the flames of the burners, if any are used to heat the molten metal. Oxygen can be generated from deeply oxidized scraps of metal introduced in the bath and nitrogen can be generated namely in arc furnaces in the region of electrodes.

As long as liquid argon, nitrogen or carbon dioxide snow is poured onto the surface of the molten bath, air above the surface of said bath is removed, thus, removing oxygen and humidity (water).

However, the very low level of residual oxygen in the vessel, usually below 1%, at the beginning of the process cannot be maintained as soon as the level of molten metal in the furnace reaches about two-thirds of the height of said furnace. Oxygen concentration rapidly increases to reach about 3% to 5% (volume concentration) at this height,which, though still being considered as a good protection, is not completely satisfactory.

SUMMARY OF THE INVENTION

Many attempts have been made to try to solve this problem. A first proposed solution has been to stop filling the furnace with metal as soon as the same reaches about two thirds of the height of the furnace and maintain the liquefied gas injection above the molten bath up to the tapping of said molten metal. It's easy to understand that this solution is not satisfactory because of its poor efficiency.

Another proposed solution the inventors had in mind consists of increasing the flow of liquefied gas which is poured onto the surface of molten metal, in order to flush out and at least dilute the oxygen present above the surface of molten metal. However, this proposal gives only a partial solution to said problem. A certain amount of liquefied gas is required to remain on the surface of molten metal throughout melt down and superheat to maintain the inert atmosphere. As soon as the critical liquified gas mass is exceeded (this amount vary with the size, power and, hence, liquid metal meniscus of the particular furnace) the situation can become dangarous. This critical mass of liquefied gas is thus determined experimentally : it must be smaller than the mass where explosions begin to take place.

Convection movements are present in the molten metal, particularly in electrical furnaces, where the surface of molten metal forms a converging meniscus : as soon as the liquefied gas reaches the wall of said furnace, it tends to penetrate the molten metal, then creating a lot of minor explosions at the surface of the metal, projecting said molten metal on the walls of the furnace and running a risk for the operator working in the vicinity of said furnace.

Of course, a cover is generally provided with the furnace, but it is not used, in practice, by the operators, because it is cumbersome and they further prefer to look at the melt throughout the entire process.

After analyzing the situation, the inventors came to the conclusion that the furnace, without a cover, must be considered as an "open-end vaporizer" and not only as a "hot plate". The liquefied gas thus vaporizes not only because of the heat generated by the surface of the molten metal (the "hot plate"), but also due to the heat radiated by the furnace wall or walls and the pieces of metal still above the molten bath. Then they further reached the conclusion that, as the molten metal level rises, the total vaporizing capacity of the furnace decreases, in terms of the heat radiated from the furnace walls, but this is more than compensated for by the increased liquid metal bath temperature. Hence, more vaporisation is occuring. This increase in vaporization rate coupled with the reduced furnace height above the bath creates a situation similar to the use of inert gases in their gaseous form, and an ingress of atmospheric air occurs due to the velocity of the rising hot gas "hitting"

the colder atmosphere. A slight increase in liquefied gas flow to the critical mass flow rate can be made but experience has shown that this still does not prevent a slight rise in oxygen concentration above the bath.

According to the invention, there is provided a sheath or skirt having substantially at least the same cross section as that of the open end of the furnace, at the top thereof, said sheath being substantially sealingly placed around the open end of said furnace, to substantially create a continuous wall thereof.

The height of that sheath will be substantially about one-third of the depth of the furnace or higher. This is generally the height required to get about 3% by volume, or sometimes less, of oxygen in the atmosphere above the molten metal throughout the process, in as much as the flowrate of liquefied gas is maintained about within the limits set forth below.

However, the minimal height of this sheath, preferably cylindrical, can be determined as follows: pieces of metal are introduced in the furnace and melted while liquefied gas, as defined above, is continuously poured onto the metal and even sometime before introducing the pieces metal according to a flow rate as set forth below. Oxygen concentration is measured with an oxygen probe placed above the surface of the molten metal at intervals throughout the melting step and is generally maintained under about 3% by volume. As soon as 3% is reached (or 2,9% or 3,1%, depending on the above limit accepted) the remaining height H from the surface of molten metal to the top of said furnace is measured. This height is the minimal height of the sheath to maintain throughout the process the required level of oxygen concentration above the molten metal, under the desired limit, such as 3% by volume.

The material of the sheath is generally a metal such as steel. However, in the case of high frequency induction furnaces, it is worthwhile to choose said material among non inductive materials, such as ceramics, asbestos, or the like.

The man skilled in the art will choose this material, its thickness, heat-conductivity, etc., in order to maintain the said sheath as cool as possible.

As furnaces or ladles have generally a circular cross section, the sheath will be preferably cylindrical, of the appropriate height disclosed above, with a diameter slightly greater than that of the open end of said furnace or ladle. The weight of the sheath will be generally sufficient to give the desired seal, to avoid air-inlet at the interface between the top rim of the furnace and the sheath. In some cases, it could be worthwhile to improve said seal by the addition of a sealing cushion all around the base edge of the sheath, said cushion being made of an adequate material, such as asbestos, ceramic or the like, well known by the man skilled in the art.

As to the flowrate of liquefied gas discharge above the molten metal, it has been found that this flowrate depends on the type of metals melted in the furnace.

In the case of heavy metals, having a density from about 0.270 to 0.290 lb/cu.in, the liquid gas consumption, to maintain the appropriate level of oxygen above the melt, may be within about 0.025 to 0.050 lb/cu.in of metal in the furnace.

In the case of light metals, having a density about 0.100 lb/cu.in, the liquid gas consumption, to maintain the appropriate level of oxygen above the melt, may be within about 0.030 to 0.060 lb/cu.in of metal in the furnace.

According to one embodiment of the invention, the flowrate of liquid inert gas is maintained at about the same value throughout the process, said flowrate being within the range of (0.025 to 0.060 lb). V, V being the total inner volume of the furnace (cubic inches).

Another object of the invention is to provide a lance for discharging liquid nitrogen or argon above a bath of molten metal or alloy, said lance being provided with self-degassing means to discharge only liquefied gas from the lance onto the surface of the molten metal or alloy. This lance is designed to prevent fluctuation phenomona due to the diphasic state of the fluid within the lance submitted to heat radiated by the furnace or metal containing vessels during the different steps of the process.

The lance according to the invention is able to deliver a calm flow of liquid which makes it possible to control the volume of liquid flowing out of the liquefied gas container with a simple pressure gauge. At this point in the feed line, at the very outlet of the tank, the state of the liquefied gas is mono-phasic (liquid) and can be measured as such. A given installation can be calibrated once for a given liquid gas : the flowrate is a function of the pressure of said liquid.

According to the invention there is provided a self degassing lance for discharging liquid nitrogen or argon above a bath of molten metal or alloy, said lance comprising a first cylindrical body and a second cylindrical body, coaxial with the first one and surrounding at least partially the same, said first cylindrical body having on a first end, means adapted to be connected to a storage vessel containing said liquid argon or nitrogen and a second open end adapted to discharge said liquid nitrogen or argon, said first cylindrical body having a first portion adapted to be placed about horizontally in use, said first portion being located on the side of said first end and a second portion adapted to be inclined, in use, said second portion being located on the side of said second open end, said first cylindrical body having its said first end located upstream on the flow of liquid in said first duct and a second end located downstream of the flow of liquid in said first cylindrical body, said second cylindrical body having first and second end flanges respectively on each end, defining a hollow chamber between said first and second cylindrical bodies, said first cylindrical body having a first hole located in the wall of said hollow chamber close to the first flange, said first hole being located, in use, in the substantially upper portion of said first cylindrical body while said second cylindrical body has a second hole located in said body, close to the second flange, said holes having diameters adapted to discharge nitrogen or argon gas in the surrounding atmosphase without substantially disturbing the flow of liquid nitrogen or argon in the first cylindrical body.

According to the invention, the hole in the first cylindrical body is smaller than that in the second cylindrical body. The area ratio between these holes will be at most 0,5 and preferably about 0.25. The larger hole in the second cylindrical body will be preferably located on the side of said first end of said first cylindrical body, while the smaller hole is preferably located on the opposite side of said hollow chamber.

BRIEF DESCRIPTION OF THE DRAWINGS

Other and further features of the invention will be clearly understood by reference to the following description of various embodiments of the invention chosen for purpose of illustration only, along with the claims and the accompanying drawings, wherein:

DESCRIPTION OF THE PREFERRED EMBODIMENT

Figure 1:
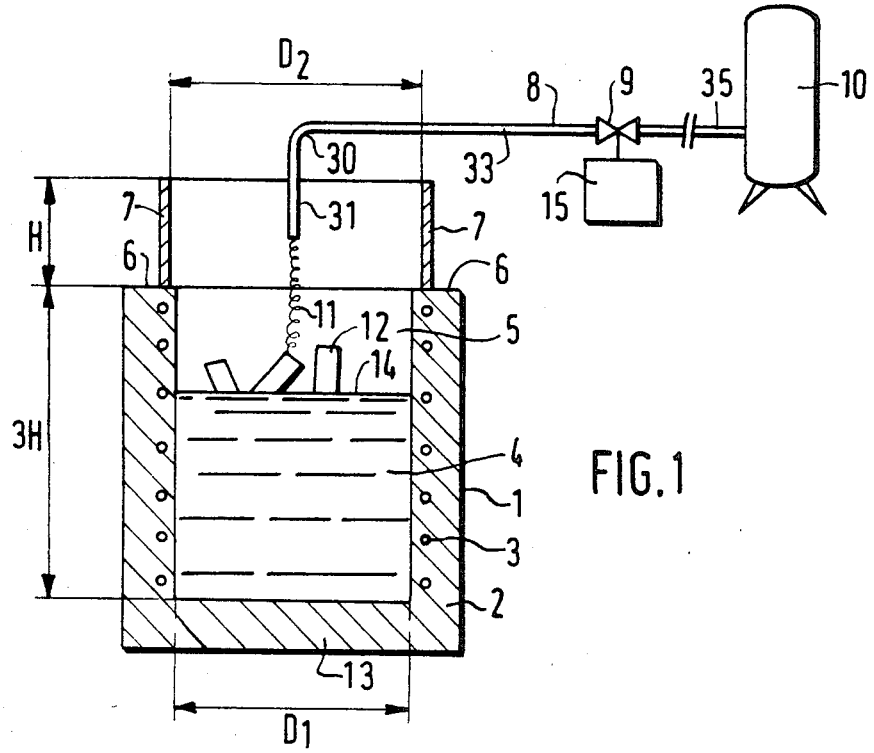
FIG. 1 is a schematic view, partially in cross section, of an installation using an induction furnace according to the invention.

FIG. 1 shows a schematic view of an induction furnace 1 of cylindrical shape (having an internal diameter D1). In the vertical wall 2 of the furnace 1 (having a bottom wall 13) are embedded helicoidally wound electrical conductors 3, to heat the bath of metal 4 by induction currents wherein some scraps of metal 12 (or new stocks) are not yet molten. The top rim 6 of the lateral wall 2 of the furnace bears a cylindrical sheath 7 made of an appropriate metal or the like. The internal diameter D2 of said sheath is slightly greater than the internal diameter D1 of the furnace 1. An L-shaped lance 8 is provided with a vertical portion 31 approximately arranged along the longitudinal axis of the cylindrical sheath 7 and a horizontal portion 33 connected through the valve 9 and the duct 35 to the liquid argon, or nitrogen storage vessel 10, said portions being connected together by an elbow portion 30. The lance 8 is used to dispense inert liquid 11 like argon or nitrogen onto the surface 14 of the molten bath. The cylindrical sheath 7 has a height H which is about one third of the depth of the furnace, from the rim 6 to the bottom wall 13.

The inventors recognized that when the surface 14 of the molten metal 4 reaches beyond about the two thirds of the total depth of the furnace, oxygen concentration in the atmosphere 5 above the molten bath dramatically increases whatever the flowrate of inert liquid 11 onto the surface 14. They also recognized that this concentration can be maintained about within the same range than before said molten metal reaches about the two thirds of the depth of the furnace by setting a cylindrical sheath 7 on the rim 6 of the furnace, said sheath surrounding the tip of the lance 8. This sheath must be set no later than when the two-thirds of the furnace are filled and preferably as soon as liquid injection begins. When the flowrate of the inert liquid increases along with the introduction of metal in the furnace (this flowrate is varying between about 0.025 and 0.060 lb/cu.in of metal in the furnace), valve 9 can be equipped, if necessary, with a well know regulation device 15 of the type increasing said flowrate when the level of molten metal in the furnace increase. But it is also easy to have a manual valve with a pressure gauge (not represented on the figure) to control the flowrate of the inert liquid, increasing said flowrate within the above defined range or maintaining it within said range at a value corresponding to a furnace full of metal.

Figure 2:
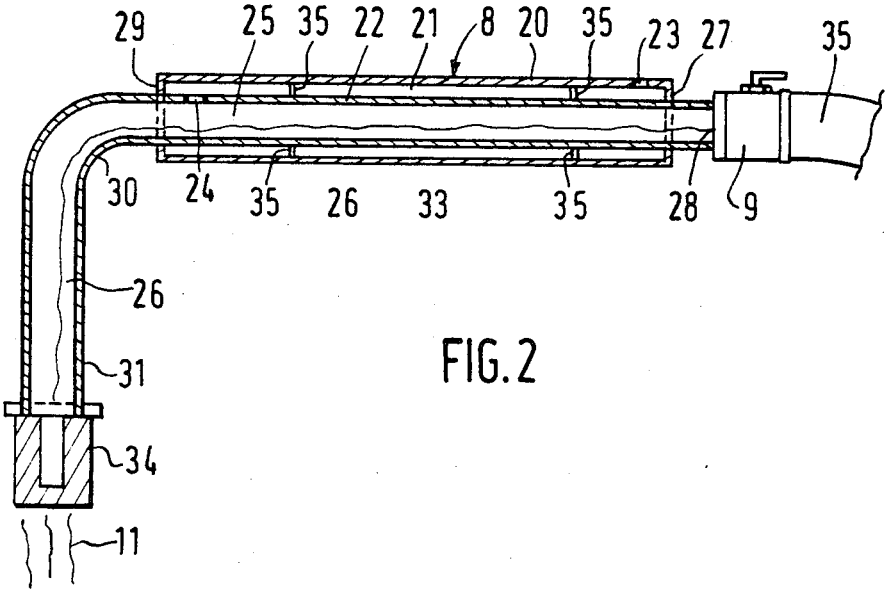
FIG. 2 is a cross section view of a lance according to the invention.

FIG. 2 shows an example of a preferred embodiment of a lance used to pour inert liquid onto the surface of molten metal. The lance 8 comprises a first cylindrical body 22 and a second cylindrical body 20, coaxial with the first one and surrounding partially the same on about the whole longitudinal portion 33 of the lance 1. The first cylindrical body 22 is extended by an elbow 30, on its downstream end, which, in turn is prolonged by an about vertical portion 31 of said lance extending about along the vertical axis of said furnace 1 (FIG. 1). A first end 28 of said first cylindrical body 22 is adapted to be connected to the vessel 10 by means of a valve 9 and a flexible hose 15. The second cylindrical body comprises two end flanges, a first one 27 located upstream near the valve 9 and a second one 29 located downstream near the elbow 30. The two cylindrical bodies 20 and 22 along with the two end flanges 27 and 29 define a hollow changer 21, having a first hole 24 close to the end flange 29, on the top of said first body 22, and a second hole 23 close to the end flange 27, on the top of said second bodies 20. Tabs 34 are connected to both cylindrical body to maintain their coaxial alignment. A diffuser 35 is connected at the lower end of the vertical portion 31 of said lance.

When the inert liquid flows (horizontally in FIG. 2) inside said first cylindrical body 22, inert gas vaporized from said inert liquid 26 can escape through the hole 24, and the escaped gas flows counter-flow to the liquid in the hollow annular space 21 defined between said first and second cylindrical bodies. Said inert gas, which is cold, escapes through the port 23 after flowing around the said second cylindrical body, thus maintaining the cold temperature of the first cylindrical body. Furthermore this cold gas cools the sheath 20 of the lance 8 (second cylindrical body) allowing said lance to withstand the heat generated by the bath of molten metal when it is used according to FIG. 1. This lance thus prevents any water condensation falling on the molten bath with the risk of generating hydrogen by heat decomposition of the water.

The distance between the lower end of the diffuser and the surface of molten metal will be maintained as small as possible, namely beyond two-thirds of metal in the furnace. This distance, smaller than the distance between the top end of the skirt and the level of molten metal, will be preferably maintained between about 1 and 4 inches.

COMPARATIVE EXAMPLES

The furnace is charged at intervals as the metal melts. The charge for a ferrous alloy is usually made of returns (gates, riser), discarded castings, non-ferrous scrap, ferro-alloys, virgin metal, etc. If the metal melted in non-ferrous, the charge will also be made of returns (gates, risers), discarded castings, non-ferrous scrap, alloying elements, virgin ingots of a known analyais, etc. The "cold-charge" is of course bulky and cannot be introduced in the furnace at once, in its entirety. The furnace thus is loaded with whatever can be put in to fill it and recharged at variable intervals as the charge "melts down". This operation goes on until the furnace is full of molten metal. Usually alloying elements are added last. The metal is introduced by hand, electromagnet, bucket, conveyors,. etc.

The liquefied gas is introduced in the furnace a few minutes after starting to charge the same when said charge beings to get hot and thus when enough the is present to vaporize the liquid gas. There is no need to introduce liquid nitrogen or argon into a cold furnace where it would accumulate onto the bottom for no practical purpose. Furthermore, an accumulation of cold liquified gas on the bottom could be detrimental to the lining.

On the top rim of an induction furnace having a circular open end of 18 inches and a depth of 24 inches was placed a skirt or cylindrical sheath of 8 inches height and 2.4 inches diameter. A flowrate of liquid argon of 2.5 lb/mn at 3 Psig was poured on the melt as soon as the charge becomes hot up to the time the furnace is full, the diffuser being at a distance of about 4 inches.

Up to the half of the furnace depth, the oxygen content above molten metal was less than 1%, then 1.5% at two-thirds of the depth and 3.0% when the furnace was full.

The same measurements were made in the same conditions and same metal bath but without said skirt. When the furnace was one third, the oxygen content was about 1.0%, then 1.5% at about the half and then about 3.0% at two-thirds of the depth, and it reached 6.0% when the furnace was full.

By using the above disclosed method, not only oxygen and nitrogen pick-up were reduced (in this latter case, by using an inert gas which is not nitrogen), but also hydrogen pick-up. According to the invention, continuously pouring or discharging a liquid inert gas onto the surface of the metal, namely at the time alloying elements are added to said melt, reduces drastically hydrogen pick-up, the sample being ready for casting without a degassing step. This was particularly true for aluminum, copper and their respective alloys. Furthermore for aluminum alloys, liquid argon or nitrogen advantageously replaced chloride and fluoride fluxes during melting while providing reduced non metallic inclusions (cleaner metal), increased tensile strength and elasticity, improved flowability, and increased metal reduced metal losses. For copper and copper alloys, an increased flowability has been noticed, along with less slag and rejections. For a Copper-Berylium alloy, the increase of beryllium recovery was from 40% to 91%.

Zinc alloys protected according to the invention before casting show a more homogenous zinc dispersion while nickel and cobatt alloys show an increased flowability, a reduced hydrogen pick-up and cleaner metal.

Steels have shown reduced slag formation, increased fluidity, reduced hydrogen pick-up and increased elongation and yield strengths.

In all cases increased fluidity permits either the lowering of the metal tap temperature if no pouring related problems are being experienced (by up to 150° F.) or the reduction of mis-runs or other pouring temperature related problems.

I claim:

1. A process for the production of a bath of molten metal or alloy of metals in a furnace to substantially prevent hydrogen pick-up in said molten metal or alloy, said process comprising the steps of introducing pieces comprising at least one of said metals in said furnace, said pieces forming a charge, heating said charge, and discharging a gas above the charge, said gas being selected from the group consisting of carbon dioxide snow, liquefied nitrogen and liquefied argon, said discharging step starting at the beginning of the heating up of said charge, up the tapping of said molten metal or alloy, the flowrate of said gas discharged in the furnace being about between 0.025 and 0.060 lb/cu.in. of metal in the furnace, said bath being substantially free from hydrogen gas throughout the process.

2. A process according to claim 1, wherein said molten metal or alloy has a surface forming a converging meniscus, the flowrate of said carbon dioxide snow, liquefied nitrogen and liquefied argon gas discharged above about the highest area of the meniscus being sufficient to allow a mass of said carbon dioxide snow, liquefied nitrogen and liquefied argon gas to remain on the surface of the liquid metal while the remaining discharge of carbon dioxide snow and liquid gas vaporizes thus purging the furnace volume of atmospheric air and moisture.

3. A process for the production of a bath of molten metal or alloy of metals in a furnace having an upper open end to substantially prevent oxygen pick-up in said molten metal or alloy, said process comprising the steps of introducing pieces comprising at least one of said metals in said furnace, said pieces forming a charge, heating up said charge, discharging a gas on the surface of the charge, said gas being selected from the group consisting of carbon dioxide snow, liquefied nitrogen and liquefied argon, said discharging step starting at the beginning of the heating up of said charge up to the tapping of said molten metal or alloy, the flowrate of said gas discharged on to the surface of said molten metal being about between 0.025 and 0.060 lb/cu.in. of metal in the furnace, and setting a sheath of an appropriate material above the upper open end of said furnace in order to surround said open end, the lower end of said sheath being in an about sealing relationship with the top rim of said open end of said furnace, said sheath being set around said open end no later than the time when the level of molten metal in the furnace reaches two-thirds of the depth of the furnace, the height of said sheath being at least equal to one third of said depth.

4. A process according to claim 3, wherein said molten metal has a density form about 0.270 to 0.290 lb/cu.in. and the flowrate of inert gas in within the range of 0.025 to 0.050 lb/cu.in. of metal in the furnace.

5. A process according to claim 4, wherein said flowrate is maintained constant throughout the process at a value which is within the highest range corresponding to the total inner volume of the furnace.

6. A process according to claim 3, wherein said molten metal has a density of about 0.100 lb/cu.in. and the flowrate of inert gas is within the range of 0.030 to 0.060 lb/cu.in. of metal in the furnace.

7. A process according to claim 6, wherein said flowrate is maintained constant throughout the process at a value which is within the highest range corresponding to the total inner volume of the furnace.

* * * * *